US009682393B2

(12) United States Patent
Erlandson et al.

(10) Patent No.: US 9,682,393 B2
(45) Date of Patent: Jun. 20, 2017

(54) FITMENT SPLASH GUARD

(71) Applicant: Ecolab USA Inc., St. Paul, MN (US)

(72) Inventors: Erika Erlandson, Edina, MN (US); Lisa Kreye, Prior Lake, MN (US); Matthew Darold Lausted, Hudson, WI (US); Gretchen King, Rosemount, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/660,417

(22) Filed: Mar. 17, 2015

(65) Prior Publication Data

US 2016/0271638 A1 Sep. 22, 2016

(51) Int. Cl.
*B05B 15/04* (2006.01)
*B05B 15/00* (2006.01)
*B65D 47/06* (2006.01)

(52) U.S. Cl.
CPC ..... *B05B 15/04* (2013.01); *B05B 15/005* (2013.01); *B65D 47/06* (2013.01)

(58) Field of Classification Search
CPC ..... B05B 15/005; B05B 15/04; B65D 47/06
USPC ..... 222/188, 189.06, 189.09, 189.1, 464.1, 222/481.5
See application file for complete search history.

(56) References Cited

U.S. PATENT DOCUMENTS 2,762,532 A * 9/1956 Packwood, Jr. ..... A47K 5/1214 222/192
3,333,741 A * 8/1967 Radcliffe ..... B67D 1/0079 222/189.09
4,141,472 A * 2/1979 Spitzer ..... B65D 83/44 137/199
4,465,479 A * 8/1984 Meisch ..... A61F 5/44 141/339
4,884,716 A * 12/1989 Steiner ..... B60K 15/04 220/202
4,971,219 A 11/1990 Dombeck et al.
5,971,221 A * 10/1999 Schwarz ..... B05B 7/2408 222/189.09

(Continued)

FOREIGN PATENT DOCUMENTS

JP 2000-038039 2/2000

OTHER PUBLICATIONS

Ecolab USA Inc., PCT/US2016/022886, filed Mar. 17, 2016, "The International Search Report and The Written Opinion of the International Searching Authority, or the Declaration", mailed Jun. 29, 2016.

*Primary Examiner* — Nicholas J Weiss
(74) *Attorney, Agent, or Firm* — McKee, Voorhees & Sease, PLC

(57) ABSTRACT

An improved system that protects a vent membrane from a liquid is provided. The system includes a container and a fitment seated in the opening of the container. A vent having a vent membrane is associated with the fitment. An elongated dip tube extends from of the fitment into the container. A splash guard is disposed within the container and may connect to the elongated dip tube. The splash guard may have a plurality of ridges extending radially from an aperture. The splash guard may alternatively comprise a tiered configuration. In operation, the splash guard permits gasses to enter the container while minimizing exposure of the vent membrane to the liquid.

14 Claims, 7 Drawing Sheets

(56) References Cited

U.S. PATENT DOCUMENTS

| | | | | | |
|---|---|---|---|---|---|
| 6,086,574 | A * | 7/2000 | Carroll | A61J 1/10 | 604/403 |
| 6,142,345 | A * | 11/2000 | Laible | B67D 7/0294 | 222/189.1 |
| 6,257,455 | B1 * | 7/2001 | Trepina | B05B 11/0016 | 222/189.09 |
| 7,461,754 | B2 * | 12/2008 | Walsh | B65D 51/1616 | 215/261 |
| 8,235,311 | B2 * | 8/2012 | Broadbent | B05B 11/0016 | 222/189.09 |
| 8,261,947 | B2 * | 9/2012 | Erdmann | B01D 46/10 | 222/189.07 |
| 8,708,320 | B2 * | 4/2014 | Steidl | C23C 16/448 | 261/122.1 |
| 8,839,991 | B2 * | 9/2014 | Smernoff | B05B 11/0016 | 222/189.09 |

* cited by examiner

FITMENT SPLASH GUARD

FIELD OF THE INVENTION

The present invention relates generally to systems for storing and dispensing liquid or slurried products, including but not limited to detergents, wetting agents, drying agents and rinse aids used in industrial cleaning processes. More particularly, but not exclusively, the present invention relates to protecting a vent membrane in a fitment connected to a chemical product container.

BACKGROUND OF THE INVENTION

In many modern industrial cleaning processes, specialized liquid chemical products are utilized to improve cleaning efficiency and minimize water consumption. For example, dishwashing or ware washing systems require liquid detergents, sanitizers, and/or other chemicals. The chemical products are metered to a dishwashing or ware washing machine in controlled amounts by a control system. Often, the chemical products are pumped from a container into the machine via a tube or otherwise transferred from a container into the machine.

The containers storing the chemical product, such as liquid detergent reservoirs, are often sealed. To meter the chemical products from the container to machine while maintaining a sealed environment, a dip tube extends from a fitment disposed within an opening in the container. The fitment may be designed to create a friction fit with the container or otherwise be secured in the opening. The fitment typically includes a vent to permit air to enter the container as chemical product is removed under negative pressure (i.e., a vacuum), thereby preventing container collapse, ensuring even fluid flow and chemical dilution, and otherwise maintaining a consistent pressure profile within the container.

In other instances, the containers store off-gassing chemicals that require ventilation. For example, peroxide-based cleaners are best stored and used from a container that includes a ventilation system. The vent is typically associated with a vent membrane to filter incoming air or escaping gas. A representative fitment with a vented insert and membrane is shown in U.S. Pub. No. 2013/0153592 to Bons et al., herein incorporated by reference in its entirety.

The chemical products are supplied to facilities in the containers. In many instances, the containers arrive with the fitments and dip tubes preinstalled. During transport, however, the containers are frequently jostled about, often causing the chemical product to come into contact with the vent membrane of the fitment. The contact or excessive contact of the chemical product with the vent membrane often causes the vent membrane to function improperly and/or fail completely, possibly arresting the entire industrial cleaning system. Therefore, a need exists in the art for a means for minimizing the potential contact between the chemical product and the vent membrane during transport and/or transfer of the containers.

In instances where the container assembly arrives preinstalled with the dip tube and fitment, a barrier, such as a film, may be disposed between the fitment and the chemical product to protect the vent membrane. During installation of the container with the dishwashing or ware washing system, however, the barrier must be removed to expose the vent. To do so requires a user remove at least the fitment, exposing the chemical product to the environment. The process increases installation time and costs. Further, the exposure increases the possibility of spillage and exposes the individual to the chemical product and chemical fumes, contrary to a purpose of the fitment. Therefore, a further need exists in the art for an improved barrier that does not need to be removed from the interior of the container during operation of the system.

SUMMARY

It is therefore a primary object, feature, and/or advantage of the present invention to improve on or overcome the deficiencies in the art.

It is another object, feature, and/or advantage of the present invention to preserve the integrity of a vent membrane during transport and/or transfer of a chemical product.

It is yet another object, feature, and/or advantage of the present invention to provide for a device that does not need to be removed from the interior of the container during operation of the system.

It is still another object, feature, and/or advantage of the present invention to provide a device that is compatible with containers of varied shapes, sizes and/or structures.

It is another object, feature, and/or advantage of the present invention to produce a splash guard that is easy to manufacture and install.

It is yet another object, feature, and/or advantage of the present invention to produce a splash guard that is inexpensive.

These and/or other objects, features, and advantages of the present invention will be apparent to those skilled in the art. The present invention is not to be limited to or by these objects, features and advantages. No single embodiment need provide each and every object, feature, or advantage.

According to an aspect of the invention, a system that protects a vent membrane from a liquid is provided. The system includes a container having an interior volume and an opening. A fitment is provided and seated in the opening of the container. The fitment has a center opening and a perimeter. A vent having a vent membrane may be associated with the fitment. An elongated dip tube may extend from the center opening of the fitment to the interior volume of the container. A splash guard disposed within the interior volume of the container is provided. The splash guard comprises an upper surface opposite a planar lower surface. The upper surface may be proximate to the fitment. The splash guard further comprises an aperture extending from the upper surface to the lower surface. The aperture may connect to the elongated dip tube. The splash guard still further comprises a perimeter substantially contoured to the perimeter of the fitment. The splash guard prevents exposure of the vent membrane to the liquid.

According to another aspect of the invention, the upper surface of the splash guard is sloped downwardly from the aperture to the perimeter. The splash guard further comprises a plurality of ridges associated with the upper surface and radially extending from the aperture to the perimeter. Each of the plurality of ridges has a top surface and opposing side surfaces. The plurality of ridges is adapted to create separation between the upper surface of the splash guard and the filament to permit air to escape through the vent membrane.

According to yet another aspect of the invention, the system that protects a vent membrane from a liquid includes a fitment having a vent and the vent membrane. An elongated dip tube is connected to and extends from the fitment. The dip tube transfers the liquid from a container to the fitment. A splash guard encircling the elongated dip tube is provided. The splash guard includes a lower portion having a first perimeter, a bottom surface, an intermediate surface, and a thickness defined between the bottom surface and the intermediate surface. The splash guard further includes an upper portion having a second perimeter less than the first perimeter, an upper surface, and a thickness defined between the intermediate surface and the upper surface. The upper portion and the lower portions may be concentric cylinders.

BRIEF DESCRIPTION OF THE DRAWINGS

Illustrated embodiments of the invention are described in detail below with reference to the attached drawing figures, which are incorporated by reference herein, and where.

DETAILED DESCRIPTION

Figure 1:
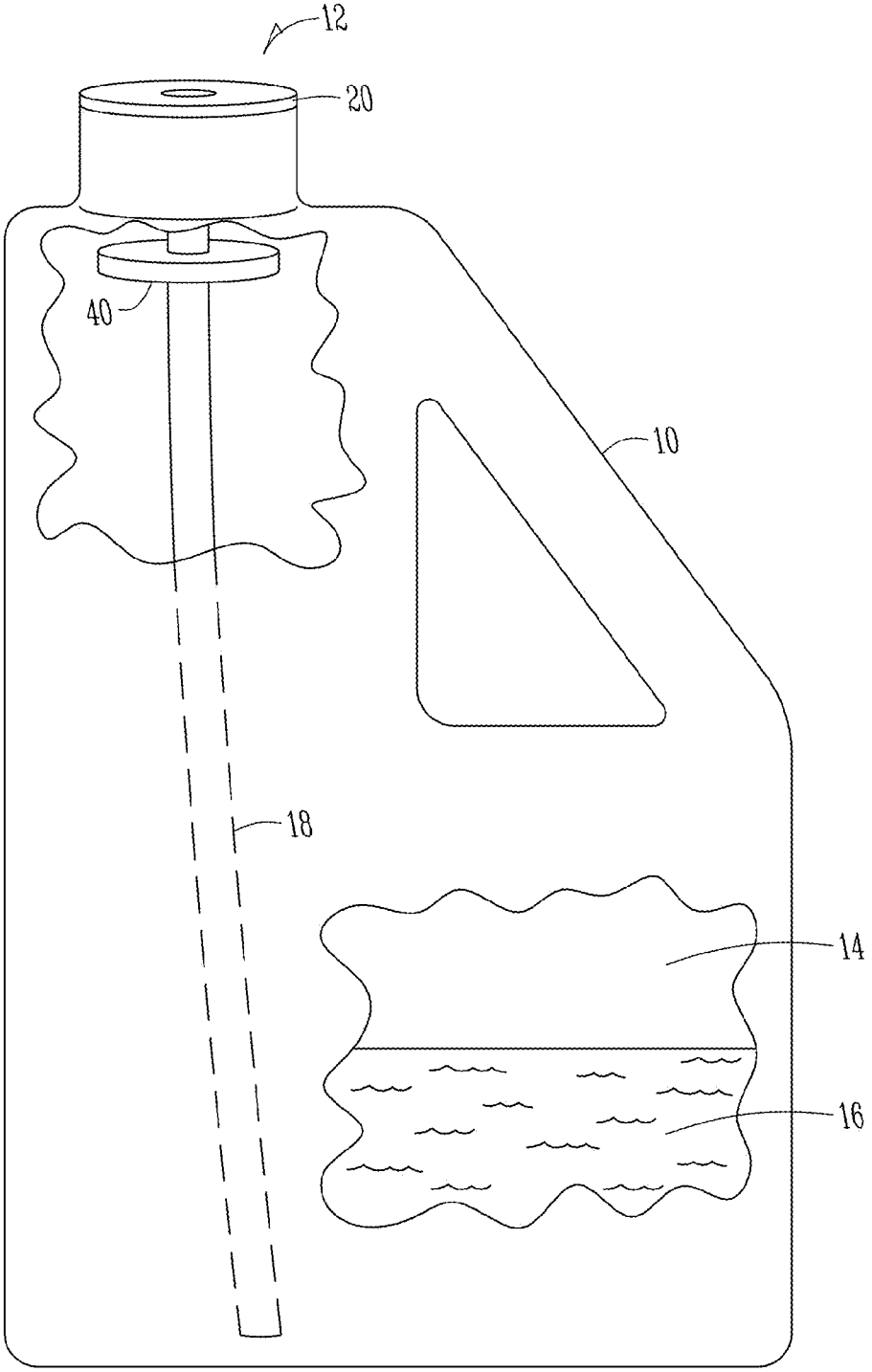
FIG. 1 is a front perspective view of a vented container system in accordance with an illustrative embodiment.

FIG. 1 illustrates an exemplary container 10 often used in an industrial cleaning process. The container 10 includes an opening 12 and an interior volume 14 adapted to store a liquid 16. The illustrated embodiment is a rigid structure, but the present invention contemplates containers of varied structure and dimension. For example, the container 10 may be a flexible pouch capable of storing a liquid. Other exemplary containers may include bins, tubs, tubes, buckets, and the like. In addition to liquid chemical products, the present invention also envisions other material compositions used in cleaning applications that may adversely affect a vent membrane of a fitment, including but not limited slurries, powders, and granules. To extract the liquid 16 from the container 10 to a dishwashing machine, ware washing machine, or other component of the cleaning system, a dip tube 18 extending through the opening 12 into the interior volume 14 of the container 10 is exposed to negative pressure.

Figure 2:
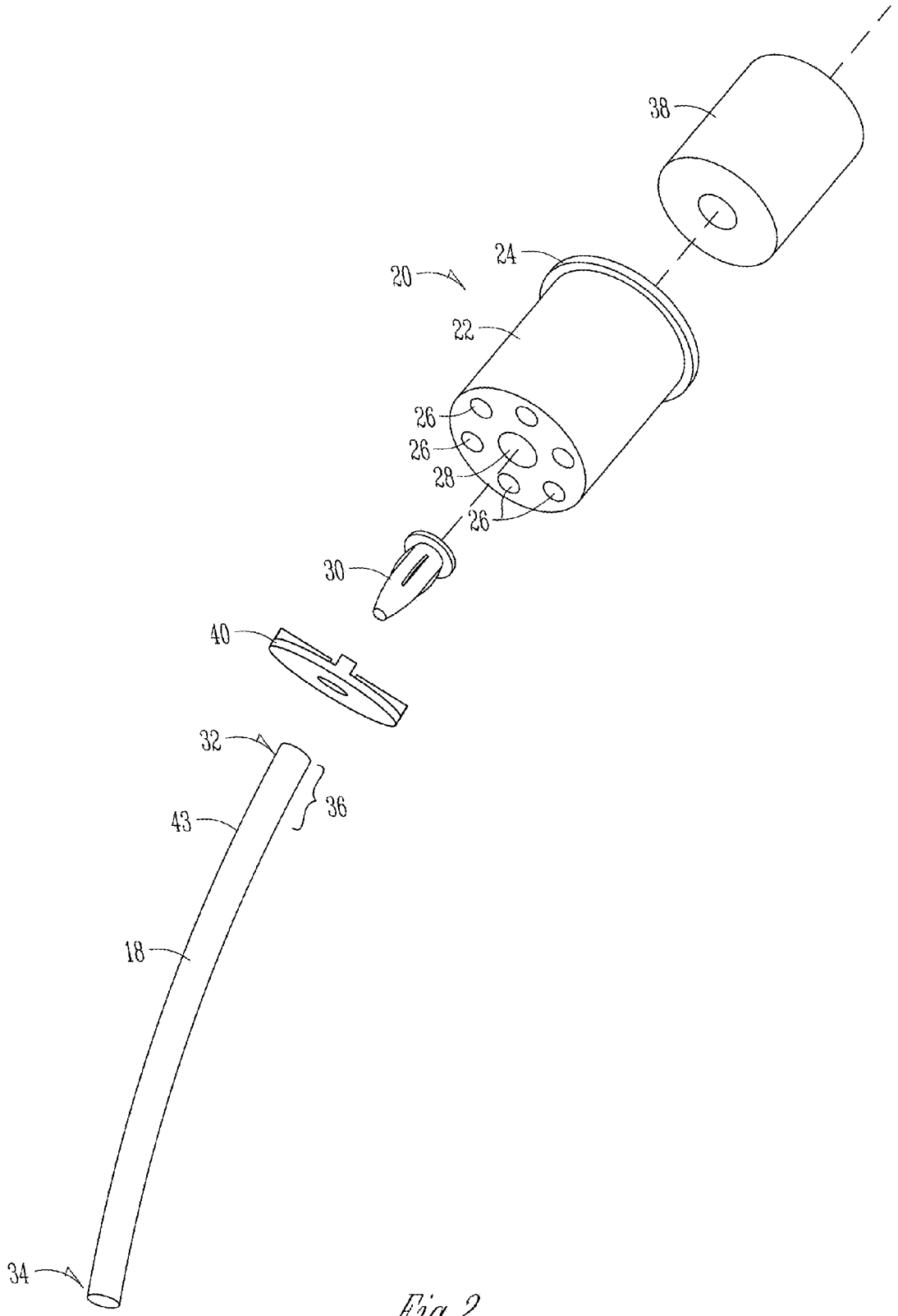
FIG. 2 is a exploded view of a vented fitment assembly in accordance with an illustrative embodiment.

Referring to FIGS. 1 and 2, a vented fitment 20 is seated in the opening 12 of the container 10. The fitment 20 may have an outer surface 22 adapted to create a friction fit with the opening 12 of the container 10. The fitment 20 may also have an upper lip 24, which may be an outwardly extending flange with a circumference slightly greater than the opening 12 of the container 10, to secure the fitment 20 within the opening 12. Because of the advantageous design of the fitment 20, a cap (not shown) may be threadably or otherwise secured to the container 10 with the fitment 20 installed. The present invention contemplates the dip tube 18 and/or fitment 20 may be installed either prior to or after transport of the container 10. The fitment 20 may be designed to quickly connect and/or disconnect to a counterpart structure (not shown) fluidly connected to the dishwashing machine, ware washing machine, other component of the cleaning system, or other end use application. The illustrated embodiment shows the opening 12 and the fitment 20 generally disposed on the top of the container 10, but it should be appreciated that any number of fitments may be included generally anywhere on the container 10. For example, the fitment 20 may be disposed in one or more walls of the container 10 or the base of the container 10 in embodiments where the container 10 is suspended. Other configurations which will be obvious to those skilled in the art are also contemplated as part of the present invention.

The fitment 20 has vents 26 configured to permit air to enter to the container 10 as liquid 14 is removed under negative pressure to prevent collapse of the container 10 and ensure even flow and dilution of the liquid 14. The vents 26 may also be configured to permit gasses to escape from the container 10, such as when the product stored therein is an off-gassing product. The vents 26 may comprise one or more orifices disposed about a center opening 28 of the fitment 20, or otherwise compatible with the design and structure of the fitment 20. The venting may alternatively be based on the material properties of the fitment 20. The center opening 28 is configured to be operatively and fluidly connected to the fitment 20 and the dip tube 18. In the illustrated embodiment, a barb 30 is secured to and extends from the fitment 20. The barb 30 may be any barbed tube fitting commonly known in the art. The barb 30 may be secured to the fitment 20 via threading, friction fit, interference fit, counterpoising locking features, or any other connective means commonly known in the art. The barb 30 alternatively may be integrally formed with the fitment 20. According to additional aspects of the invention, the dip tube 18 may be secured to the fitment 20 through other means, including but not limited to pinning, clamping, fastening, and threading.

The dip tube 18 is connected to the fitment 20 via the barb 30 or otherwise. The dip tube 18 has a first end 32 proximate to the fitment 20 and a second end 34 generally disposed in the interior 14 of the container 10. The first end 32 of the dip tube 18 may be slidably mounted on the barb 30. The barb 30 is sized to create a friction fit with a portion 36 of the dip tube 18.

A vent membrane 38 is associated with the fitment 20. The vent membrane 38 may be comprised of expanded polytetrafluoroethylene (ePTFE) to allow gasses to pass through the vents 26, while not allowing the liquid to pass through. Other gas-permeable, liquid-impermeable membranes may be used, including but not limited to those comprising PTFE, polypropylene or polyethylene. The vent membrane 38 may be toroidal and configured to be inserted into the fitment 20, as illustrated, or of any shape and size suitable to achieve the objects of the invention. For example, the vent membrane 38 may be a film associated with the vents 26. The vent membrane 38 may be multilayered, either coaxially or linearly, of unitary construction, or varying cross section or thickness, or of any material and/or physical properties to effectively filter the air entering the container 10 during operation of the cleaning system.

During shipment of the container 10 filled with liquid 14, the container 10 may be agitated for any number of reasons. Due to the composition of the vent membrane 38 and the chemical products often used in cleaning processes, contact between the two reduces the effectiveness of the vent membrane 38. To minimize or preferably prevent contact of the liquid 14 with the vent membrane 38, a splash guard 40 is installed on the outer surface 43 of the dip tube 18, as shown illustratively in FIGS. 1 and 2. The splash guard 40 is secured to the dip tube 18 proximate the fitment 20. The splash guard 40 may be positioned on the portion 36 of the dip tube 18 such that a gap exists between the splash guard 40 and the fitment 20. The splash guard 40 may alternatively be secured to the barb 30 and/or in contact with the fitment 20. Because of the advantageous shape of the splash guard 40, air will be able to enter the container 10 in configurations where the splash guard 40 is in contact with the fitment 20.

The geometry of the splash guard 40 may be manufactured as desired to accommodate product containers with differing dimensions and differing neck geometries. Further, the splash guard 40 may be manufactured through injection molding, but the present invention contemplates other manufacturing methods such as thermoforming, three-dimensional printing, pressure-formed plastic, low pressure molding, coinjection, spin casting, and the like. Still further, the splash guard 40 may be composed of plastic such as polyethylene terephthalate (PETE), high density polyethylene (HDPE), polyvinyl chloride (PVC), low density polyethylene (LDPE), and/or polypropylene (PP). The material is suitably rigid and does not adversely react with the chemical product contained within the container 10. The shape of the splash guard 40, together with the manufacturing and materials options, advantageously provides for an inexpensive device that is easy to manufacture.

Figure 3A:
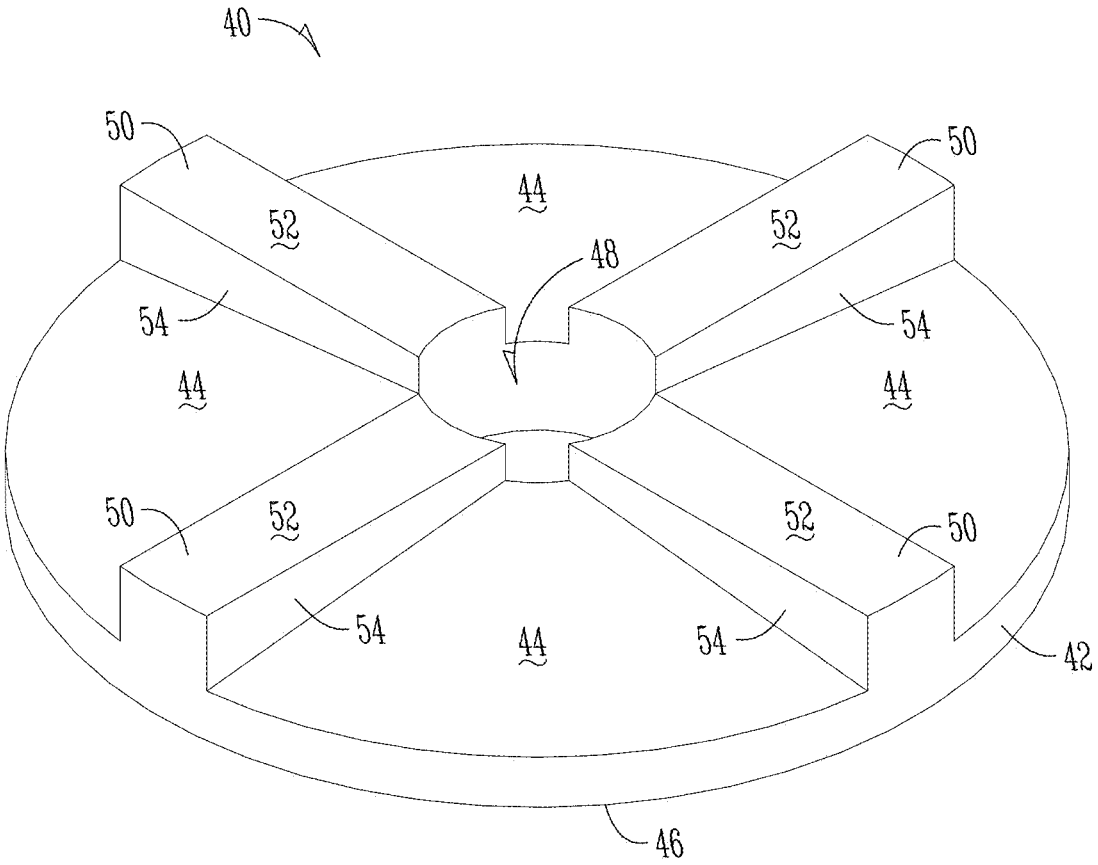
FIG. 3A is an isometric elevation view of a splash guard in accordance of an illustrative embodiment.
Figure 3B:
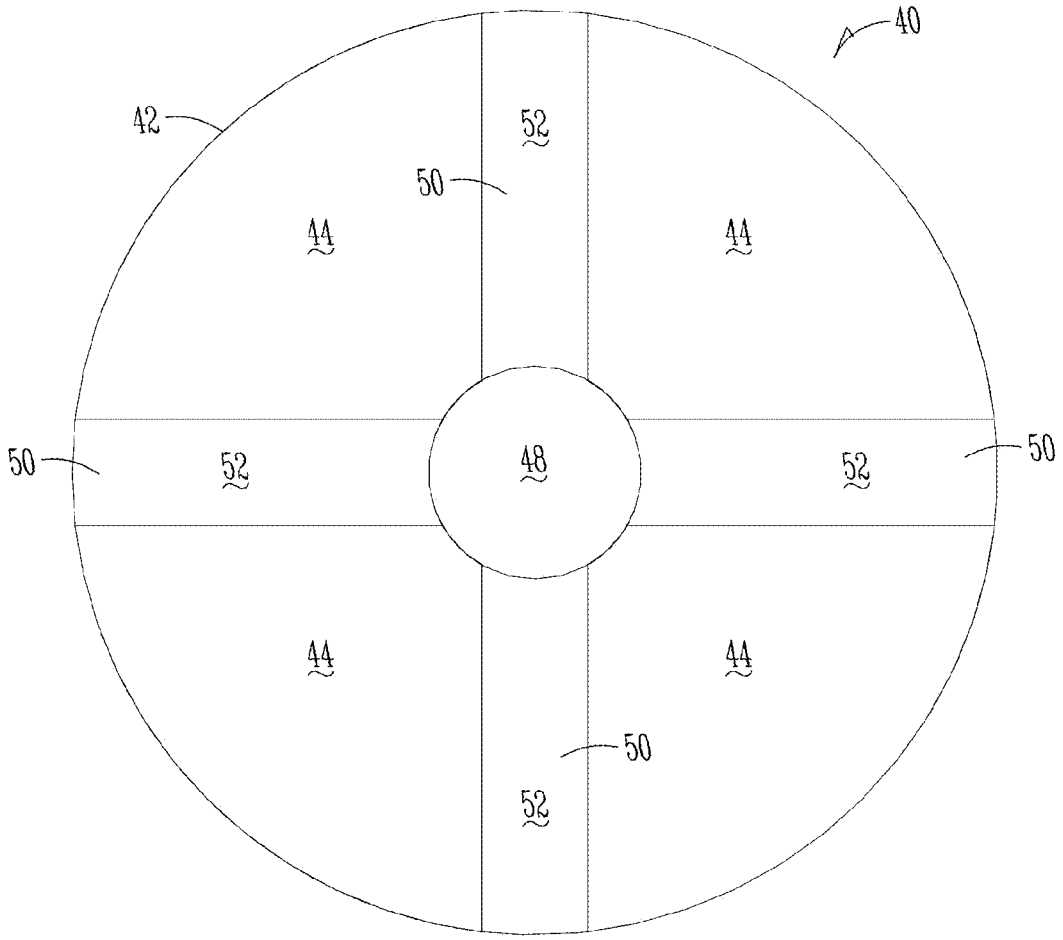
FIG. 3B is a top plan view of a splash guard in accordance with an illustrative embodiment.
Figure 3C:
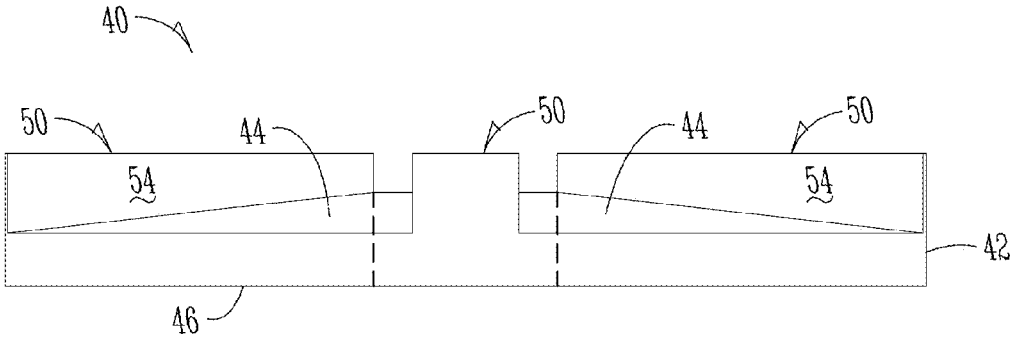
FIG. 3C is a front elevation view of a splash guard in accordance with an illustrative embodiment.

Referring to FIGS. 3A, 3B and 3C, an embodiment of a splash guard 40 is illustrated. The splash guard 40 has a perimeter 42 generally contoured to the outer surface 22 of the fitment 20. In an embodiment, the perimeter 42 is circular, resulting in a substantially disc-shaped splash guard 40. The splash guard 40 includes an upper surface 44 and a lower surface 46. The lower surface 46 may be substantially planar, but the present invention contemplates the lower surface 46 may be concave or convex. The upper surface 44 may also be substantially planar. In the illustrated embodiment, the upper surface 44 is sloped from an aperture 48 to the perimeter 42. In such a configuration, the splash guard 40 is a frustum of a cone. The aperture 48 may be centrally located so as to impart symmetry about the aperture 48. The aperture 48 may be sized and shaped to create a friction fit with the first end 32 of the dip tube 18 and/or the barb 30. In an embodiment, the aperture 48 includes two perpendicular slots (i.e., a criss-cross configuration) associated with four deformable flaps to create a friction fit with the dip tube 18. When installed, the upper surface 44 is proximate to the fitment 20.

The splash guard 40 may include a plurality of ridges 50 extending upwardly from the upper surface 44. The ridges 50 may be disposed radially about the aperture 48. The ridges 50 may be circular, triangular, or any other shape suitable to achieve the objects of the invention. In the illustrated embodiment, the ridges 50 are rectangular and have a top surface 52 and two opposing surfaces 54. The ridges 50 create separation between the upper surface 44 or the splash guard 40 and the fitment 20. In particular, in instances where the top surface 52 contacts the fitment 20, the upper surface 44 is spaced at a sufficient distance to permit gasses to enter or exit the container 10. At the same time, however, the splash guard 40 is sufficiently close to the fitment 20 to prevent liquid 14 from entering the vents 26, which could possibly comprise the integrity of the vent membrane 38.

Figure 4A:
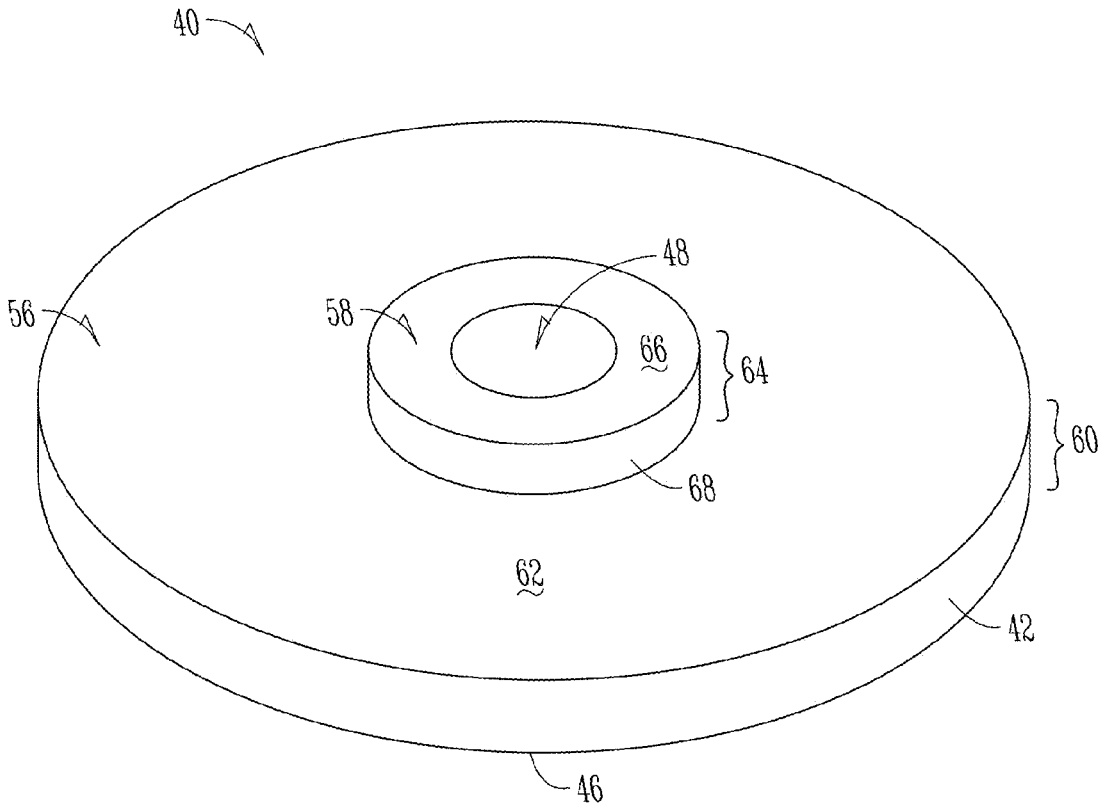
FIG. 4A is an isometric view of a splash guard in accordance of an illustrative embodiment.
Figure 4B:
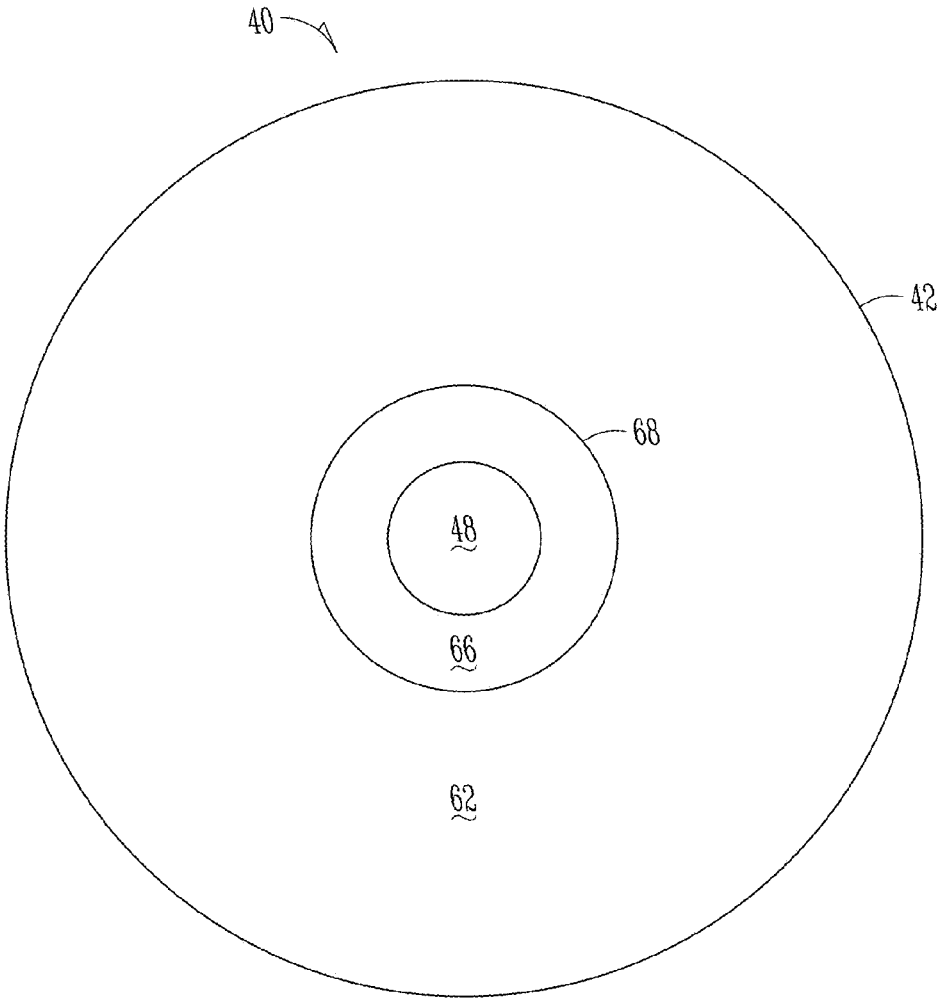
FIG. 4B is a top plan view of a splash guard in accordance with an illustrative embodiment.
Figure 4C:
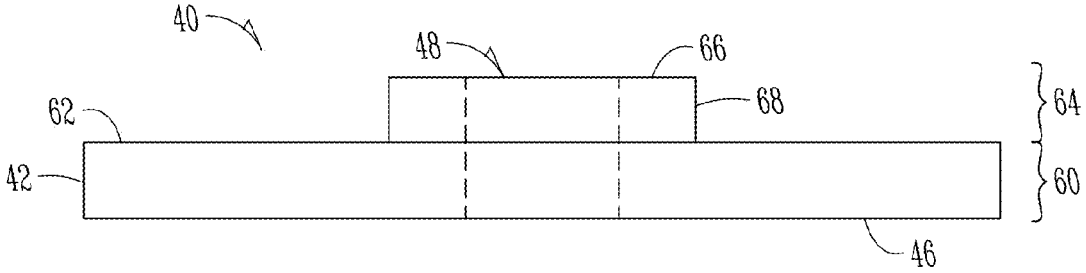
FIG. 4C is a side elevation view of a splash guard in accordance with an illustrative embodiment.

In another embodiment of the invention illustrated in FIGS. 4A, 4B and 4C, the splash guard 40 has a tiered configuration. Similar to the splash guard 40 described above, the illustrated embodiment has a perimeter 42, a lower surface 46 and an aperture 48. The splash guard 40 has a lower portion 56 and an upper portion 58. The lower portion 56 has a thickness 60 defined between the lower surface 46 and an intermediate surface 62. The upper portion 58 has a thickness 64 defined between the intermediate surface 62 and an upper surface 66. Further, the upper portion 58 may have a perimeter 68 smaller than the perimeter 42 of the splash guard 40. In the illustrated embodiment, the configuration results in two coaxial cylinders. The present invention envisions varied configurations without deviating from the objects of the invention. For example, the intermediate surface 62 may be sloped from the perimeter 68 of the upper portion 58 to the perimeter 42 of the splash guard 40. The lower surface 46 may be planar, concave or convex. The upper surface 66 may be sloped. The intermediate surfaces 62 may include a plurality of ridges similar to those described above.

In operation, the splash guard 40 is installed on the barb 30 and/or the dip tube 18, and more particularly on the portion 36 of the dip tube 18 proximate the fitment 20. The upper surface 66 may be spaced at a relatively small distance from the fitment. If the upper surface 66 is in contact with the fitment 20, the tiered configuration permits air to enter the container 10 yet prevent liquid 14 from entering the vents 26 to comprise the integrity of the vent membrane 38.

Figure 5:
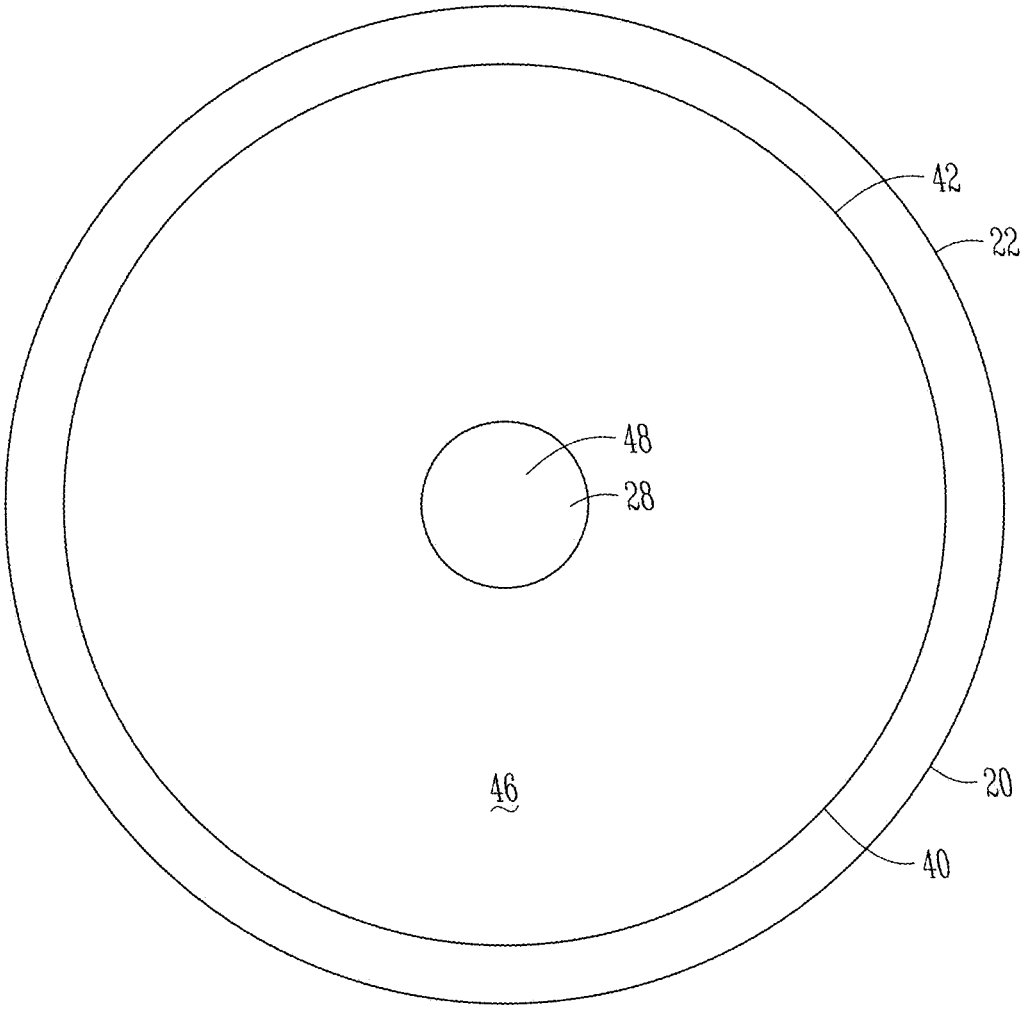
FIG. 5 is a bottom plan view of a splash guard installed on a fitment in accordance with an illustrative embodiment.

Referring to FIG. 5, a bottom plan view of a splash guard 40 disposed below a fitment 20 is provided. As previously disclosed, the perimeter 42 of the splash guard 40 is contoured to the outer surface 22 of the fitment 20. In the illustrated embodiment, the splash guard 40 and the fitment 20 are coaxially aligned and circular in profile. The present invention contemplates any number of profiles based on the dimensions, shape and size of the opening 12 of the container 10. Furthermore, the perimeter 42 of the splash guard 40 may be slightly less than the dimensions of the outer surface 22 of the fitment 20. This advantageously permits incoming gasses to track around the perimeter 42 of the splash guard while providing little clearance for the liquid 14 to breach the vents 26 of the fitment 20.

The invention describes the embodiments of the invention in the context of chemical products for cleaning processes, and more particularly dishwashing and ware washing applications. The objects of the invention contained herein may be applied across varied industries. For example, the splash guard may be incorporated into water care technology, such as water bottles with a vent and vent membrane (e.g., means for water purification). Further, the splash guard may be incorporated into pest elimination products, particularly those requiring vented containers to store hazardous chemicals. Still further, the splash guard may be incorporated into vented containers often used in the textile and/or laundry industries. Still yet further, the splash guard may be incorporated into the health care industry, as medical devices and/or containers used therein often require aspiration of a fluid.

The invention is not to be limited to the particular embodiments described herein. In particular, the invention contemplates numerous variations in the type of ways in which embodiments of the invention can be applied to protecting a vent membrane in a fitment connected to a liquid product container during transport. The foregoing description has been presented for purposes of illustration and description. It is not intended to be an exhaustive list or limit any of the invention to the precise forms disclosed. It is contemplated that other alternatives or exemplary aspects that are considered included in the invention. The description is merely examples of embodiments, processes or methods of the invention. It is understood that any other modifications, substitutions, and/or additions can be made, which are within the intended spirit and scope of the invention. For the foregoing, it can be seen that the invention accomplishes at least all that is intended.

The previous detailed description is of a small number of embodiments for implementing the invention and is not intended to be limiting in scope. The following claims set forth a number of the embodiments of the invention with greater particularity.

What is claimed is:

1. A system for protecting a vent membrane from a liquid, the system comprising:

a container having an interior volume and an opening;

a fitment adapted to seat in the opening of the container, the fitment having a center opening and a perimeter;

a vent associated with the fitment and including the vent membrane;

an elongated dip tube extending from the center opening of the fitment to the interior volume of the container; and a splash guard disposed within the interior volume of the container adjacent the fitment to allow venting of the container while blocking liquid from contacting the vent membrane;

said splash guard comprising:

an upper surface opposite a lower surface, the upper surface being proximate to the fitment;

an aperture extending from the upper surface to the lower surface, the aperture adapted to connect to the elongated dip tube;

a perimeter substantially contoured to the perimeter of the fitment;

a plurality of ridges associated with the upper surface and radially extending from the aperture to the perimeter, each of the plurality of ridges having a top surface and opposing side surfaces; and wherein the plurality of ridges is adapted to create separation between the upper surface of the splash guard and the fitment to permit air to escape through the vent membrane.

2. The system of claim 1 wherein the upper surface of the splash guard is sloped downwardly from the aperture towards the perimeter.

3. The system of claim 1 wherein the top surface of each of the plurality of ridges are substantially planar and planar to one another.

4. The system of claim 1 wherein the splash guard is a frustum of a cone.

5. The system of claim 1 wherein the perimeter of the splash guard is smaller than the perimeter of the fitment.

6. The system of claim 1 wherein the splash guard and the fitment are separated by a portion of the dip tube.

7. The system of claim 1 further comprising:

a barb associated with the fitment and extending into the dip tube, the barb creating a frictional fit with a portion of the dip tube, wherein the splash guard is secured to the portion of the dip tube.

8. The system of claim 7 wherein the splash guard is secured to the barb between the fitment and the portion of the dip tube.

9. A system for protecting a vent membrane from a liquid, the system comprising:

a fitment having a vent and the vent membrane;

an elongated dip tube connected to and extending from the fitment, the dip tube adapted to transfer the liquid from a container to the fitment;

a splash guard encircling at least a portion of the elongated dip tube to allow a gaseous path while blocking liquid from contacting the vent membrane;

said splash guard comprising:

(a) a lower portion having a first perimeter, a bottom surface, an intermediate surface, and a thickness defined between the bottom surface and the intermediate surface; and (b) an upper portion having a second perimeter less than the first perimeter, an upper surface, and a thickness defined between the intermediate surface and the upper surface;

(c) wherein the upper portion and the lower portions are coaxial cylinders.

10. The system of claim 9 wherein the first perimeter is contoured to a perimeter of the fitment.

11. The system of claim 9 wherein the bottom surface, the intermediate surface, and the upper surface are planar and parallel.

12. The system of claim 10 wherein the first perimeter is less than the perimeter of the fitment.

13. The system of claim 9 further comprising:

a barb adapted to create a friction fit between the fitment and inner circumference of a portion of the dip tube, wherein the splash guard is secured to an outer circumference of the portion of the dip tube.

14. A method for protecting a vent membrane from a liquid, the method comprising the steps of:

providing an elongated tube having a first end, a second end, an inner circumference and an outer circumference;

connecting a fitment to the first end of the elongated tube, the fitment having a center opening associated with the elongated tube;

installing a splash guard on the outer circumference of the elongated tube, the splash guard having an aperture adapted to create a friction fit with the outer circumference of the elongated tube;

sliding the splash guard along the outer circumference of the elongated tube to a desired position;

orienting the splash guard on the elongated tube, wherein a plurality of ridges extending radially from the aperture of the splash guard are proximate to the fitment;

feeding the second end of the elongated tube into a container; and installing the fitment into an opening on the container.

* * * * *